United States Patent [19]

Wren, Jr. et al.

[11] 4,008,499

[45] Feb. 22, 1977

[54] COLLAPSIBLE PLAYPEN

[76] Inventors: William Arthur Wren, Jr., 736 Ensign Ave., Beachwood, N.J. 08722; Joseph Paul Gibson, Jr., 52 Sunset Drive, Howell, N.J. 07731

[22] Filed: Dec. 3, 1975

[21] Appl. No.: 637,272

Related U.S. Application Data

[63] Continuation-in-part of Ser. No. 538,769, Jan. 6, 1975, abandoned.

[52] U.S. Cl. ..... 5/99 C

[51] Int. Cl.[2] ..... A47C 29/00

[58] Field of Search ..... 5/99 R, 99 C, 111

[56] References Cited

UNITED STATES PATENTS

| | | | |
|---|---|---|---|
| 2,573,526 | 10/1951 | White | 5/99 C |
| 2,574,079 | 11/1951 | White | 5/99 C |

*Primary Examiner*—Paul R. Gilliam
*Assistant Examiner*—Andrew M. Calvert
*Attorney, Agent, or Firm*—Charles I. Brodsky

[57] ABSTRACT

A playpen which can be collapsed to a substantially cylindrical shape to increase its ease of portability.

10 Claims, 8 Drawing Figures

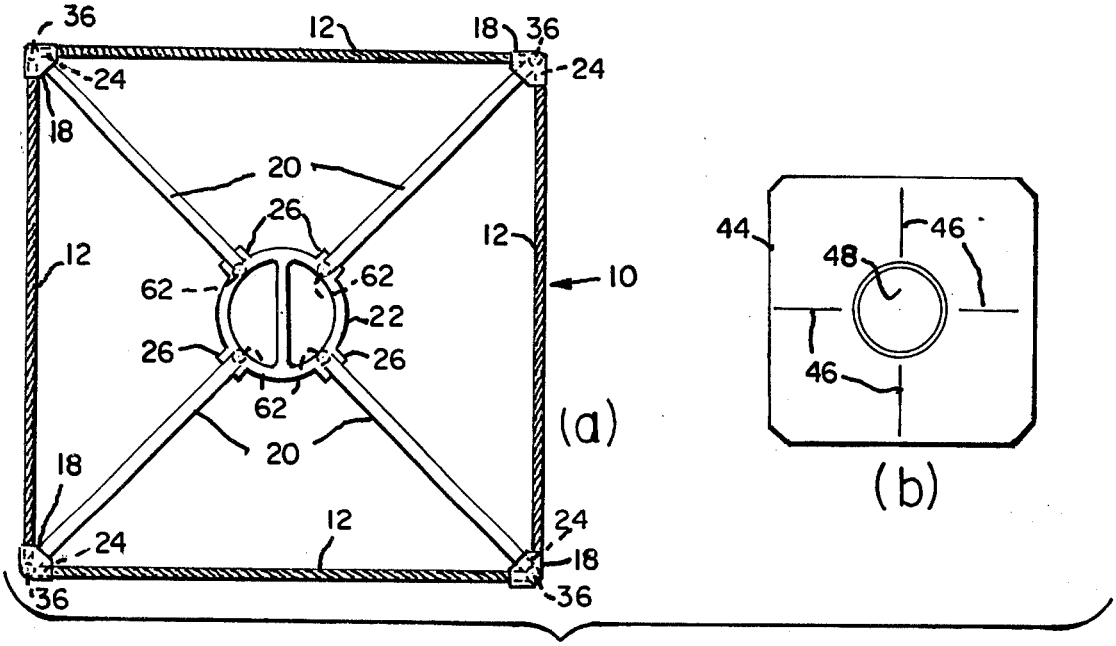
Fig. 1.
Fig. 2.
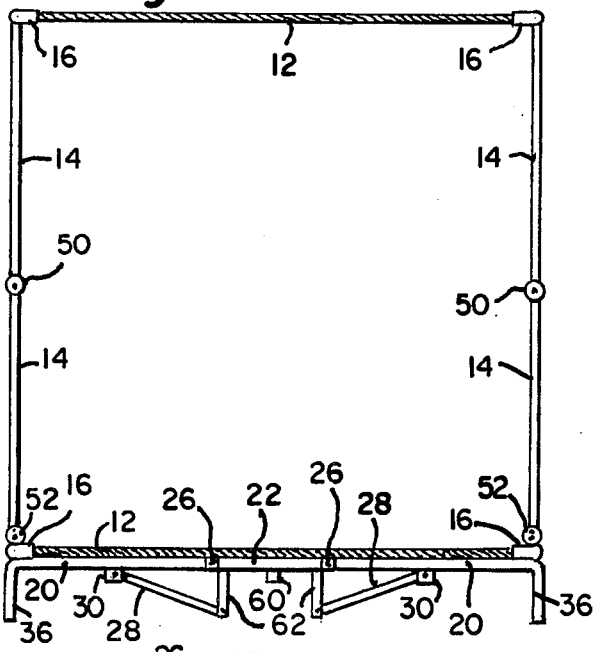
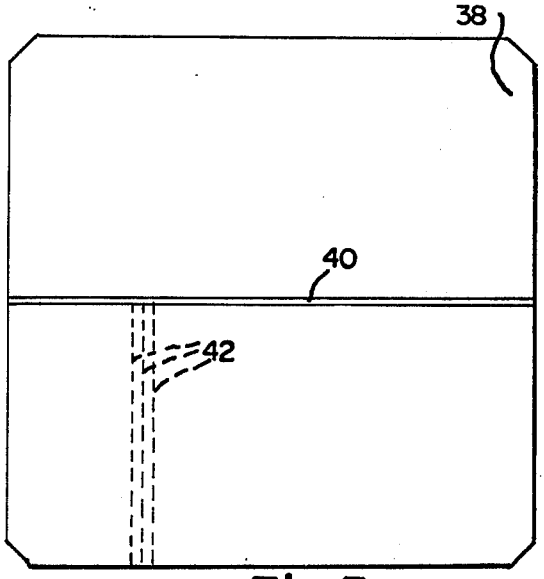
Fig. 5.
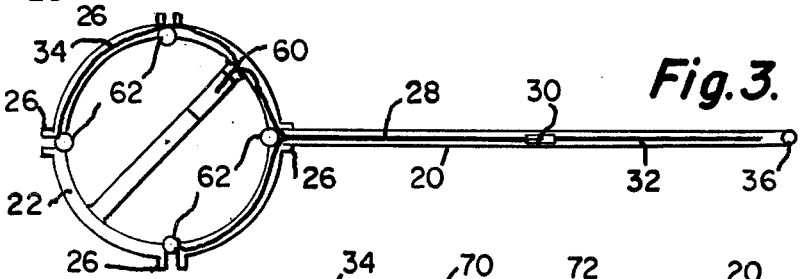
Fig. 3.
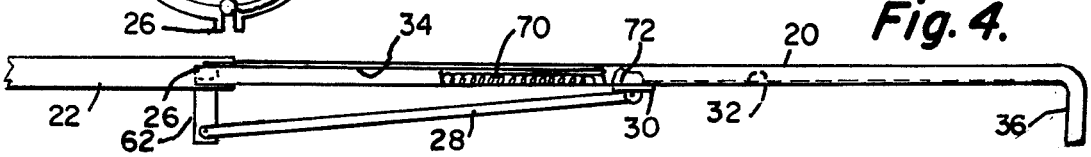
Fig. 4.

Fig. 6.
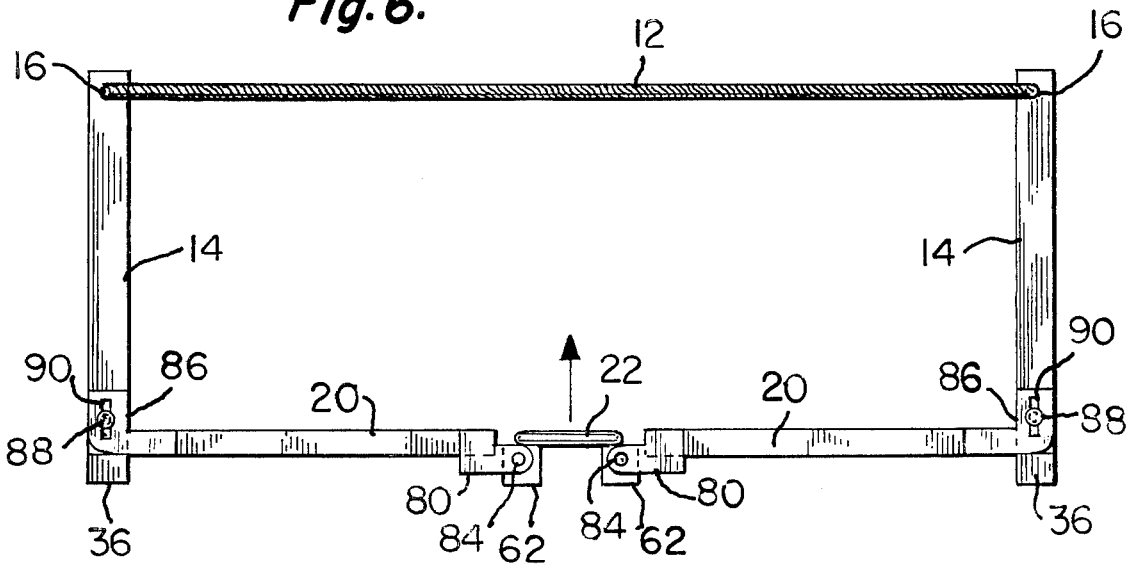
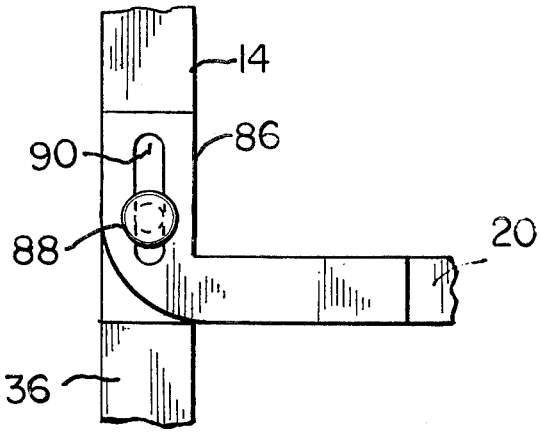
Fig. 7.
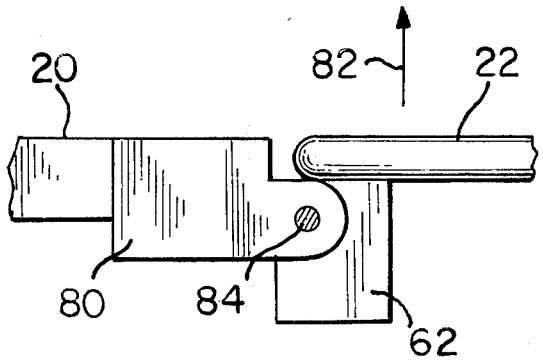
Fig. 8.

COLLAPSIBLE PLAYPEN

This is a continuation-in-part of application Ser. No. 538,769, filed Jan. 6, 1975, now abandoned.

Field of the Invention

This invention relates to playpens and, more particularly, to a playpen which can be collapsed for easy carrying about.

BACKGROUND OF THE INVENTION

Those collapsible playpens which are presently available suffer from the general disadvantage that, although termed "portable", they really cannot be carried about, either too far or too long. This results from their being constructed to collapse to a generally flat configuration, of substantially the same height and width as when opened, and only of some reduced depth. For example, some collapsible playpens which stand 36–40 inches high and 36–40 inches square when opened, can be collapsed to a depth of about 6–10 inches, but continue of the same height and width as before.

SUMMARY OF THE INVENTION

As will become clear hereinafter, the playpen of the present invention can be collapsed to a substantially cylindrical shape — for example, of some 22–24 inches in length and some 12 inches in diameter. As such, the playpen can easily be inserted into a vinyl type duffel (or similar such) bag, to be easily carried from place to place. In accordance with the invention, the collapse of the open playpen to this cylindrical shape follows, in part, from the inclusion of corner legs which are rotated downwards when an included support ring affixed at the bottom of the playpen is pulled upwards. A plurality of support arms connect the ring to the corner legs, so as to impart the proper movement as the support ring is lifted. A series of hinge arrangements are employed between the corner legs and the support arms in resisting closure of the playpen unless the corner legs are folded over the support arms before the support ring is raised. To facilitate the opening of the closed playpen, one embodiment of the invention incorporates a series of spring assisted slides, biased in a direction to extend the support arms in a direction to ease the unfolding of the corner legs from atop the support arms.

BRIEF DESCRIPTION OF THE DRAWINGS

These and other features of the invention will be more clearly understood from a consideration of the following description taken in connection with the accompanying drawings in which:

FIG. 1 is a top view of a collapsible playpen embodying the invention, when opened;

FIG. 2 is a side view of one embodiment of a collapsible playpen in its open condition, showing the support ring-support arm construction;

FIGS. 3 and 4 are bottom and side views, respectively, of the support ring-support arm construction for the playpen of FIG. 2;

FIG. 5 is a top view of a mattress pad which may be employed in the playpen construction of the invention;

FIG. 6 is a side view of another embodiment of a collapsible playpen in its open condition, showing a different support ring-support arm construction; and FIGS. 7 and 8 are detail views of hinge arrangements which may be used with the playpen of FIG. 6.

DETAILED DESCRIPTION OF THE DRAWINGS

Referring, now, to FIGS. 1–5 of the drawings, the construction of the collapsible playpen embodiment of the invention there illustrated 10 may be of the type which, when opened, is substantially 36 inches square and 30 inches high. Although not shown as such, the playpen 10 will be understood to be constructed of one-fourth inch grid netting such as nylon, or any other material employable to form the sides of children's playpens. Along the tops and bottoms of this netting — such as sewn to, and over it — are vinyl covered padded poly ropes 12, which hold the netting in place and give it increased strength when the playpen is open. The corner legs of the playpen 14 are provided with guides 16 through which the poly rope 12 passes, and to which it is secured. Covering the rope 12 at these guide locations are four bumper supports 18, similar to the padded turn buckles used in boxing rings. As shown, similar rope guides are provided at the top and bottom portions of the corner legs of the playpen, but only the upper guides are provided with the bumper protection. Also secured at the bottom portion of the corner legs 14, but beneath the poly rope 12, are a plurality of support arms 20 — four, in the illustrated embodiment, the other ends of which are secured at substantially spaced intervals along the circumference of a support ring 22 — with either or both securements being by hinges or similar such devices 24, 26, the device 26 preferably being only pivotable in nature.

The support arms 20 are part of assemblies, each of which is approximately 22 inches in length, and includes a connecting rod 28 and spring assisted slider 30 capable of moving within a track 32 of the arm 20. A locking cable 34 is included, which when released, permits the connecting rod 28 and slider 30 to move within the track 32, and which when locked, prevents such motion. Support legs 36 are incorporated as part of the support arm 20, and will be seen to be those legs which support the playpen on the floor. Although not so shown, it will be understood that casters may be affixed to such support legs 36 for use in moving the playpen about a room.

In collapsing the playpen, the first thing to be done is to remove the mattress pad 38 used within the playpen construction. Such pad is shown as incorporating a fold line 40 about which the pad may be folded. Where the mattress pad 38 is constructed of a closed cell foam material, this fold line 40 may be a one-half inch wide portion across the length of the pad 38, devoid of material so that the pad may be folded substantially in half. Battens 42 may be secured to the underside of the pad 38, if desired, to add support to the pad — in which case, the battens may be of a length slightly less than half the width of the pad 38. The pad, once removed, may be placed aside, for use at a later interval of time, in a manner to be subsequently described.

Just as the mattress pad 38 may incorporate battens for added support, so, too, may the bottom portion of the playpen 44, on which the mattress rests, incorporate battens for strength. Such battens 46 are placed to add support between the underneath support arm areas of the playpen construction, with the bottom portion being constructed of a heavy weight material, such as canvas, heavy weight nylon, or denim — essentially a solid cloth type material. As shown in FIGS. 1*a* and *b*, the top view of the open playpen of the invention without the bottom portion 44 and that bottom portion itself, respectively, the bottom portion is provided with a hole 48 concentric to the support ring 22 and laced to it, such that the support ring can be grasped once the mattress pad 38 is removed and so that the lifting upwards of the support ring 22 will, at the same time, pull the cloth bottom 44 along with it.

To close the playpen, the corner legs 14 are first folded in half, inwardly of the playpen 10, about locking type pivot hinges 50, and then folded again around a similar locking type pivot hinge 52 so as to lie over the support arms 20. As the poly rope 12 fits within the guides 16 in these legs, folding the legs 14 inwards in the described manner also carries the poly rope 12 and side netting along with it. With such step, the playpen essentially is being collapsed flat, but is still supported to the floor by the legs 36.

The support ring 22 is then grasped from above, and a lock release 60 within it is actuated, to free the cable 34 and permit the connecting rod 28 and slider 30 to move within the track 32. As shown in the drawings, the ring 22 also has a plurality of legs 62 to assist in supporting the playpen — four, in this embodiment of the invention —, to the remote ends of which the connecting rods 28 of each support arm assembly are secured. Lifting upwards on the support ring 22 then pulls the support legs 62 upwards, also, and moves the connecting rods 28 within the tracks 32 in a direction towards the ring 22, from right to left in FIGS. 3 and 4. Once the sliders 30 reach the limit of their travels towards the support ring 22, further lifting of the ring tends to pull the connecting arms 28, and the support arms 20, in a downward direction, thereby rotating downwards the entire support arm assembly, the corner legs 14 which are folded atop it, and the side netting which is secured to these legs. Further lifting of the support ring 22 thus rotates the support arm and corner legs in a direction opposite to the upwards movement of the support ring so as to align it, generally vertically. It will be seen that the diameter of the collapsed playpen, when the support ring is fully lifted upwards, will generally be determined by the diameter of the support ring and by the distance between its circumference and the near-most limit of slider travel at which the support arm rotation begins. In this manner, the playpen will collapse to a cylindrical configuration.

In transporting the cylindrically folded playpen, the removed mattress pad 38 could first be inserted, while folded and rolled up, into a vinyl, or other type, duffel bag, and, when in place, will generally unravel towards filling the outer definition of the bag. With the support ring 22 lifted sufficiently upwards so as to collapse the support arms 20 and the folded corner legs 14, a strap or similar such holding means could be wrapped around the collapsed playpen to hold it firmly secured. The cylindrically collapsed playpen could then be inserted within the void formed in the duffel bag as the mattress unravelled within the enclosure. Appropriate fasteners could then be used to close the bag, which could then be carried about by means of an attached handle or similar such arrangement.

To open the collapsed playpen once it and the mattress are removed from the carrying bag, all that is necessary is to remove the holding strap, free the lock release 60 once again, and push downwards on the support ring 22. This forces the connecting rods 28 outwardly, away from the ring 22 and causes the slider 30 to move within the track 32, to extend the support arms 20 in a horizontal direction, counter-clockwise in FIGS. 3 and 4. In this sense, a spring bias assist 70 is incorporated as part of the support arm assembly, to move the connecting rods 28 outwardly to their fullest point where they are snapped into place by a suitable locking mechanism 72. Unfolding of the corner legs 14, in opposition to the previously described manner, extends not only the corner legs but the netting and poly ropes, as well, thereby returning the playpen to its open, usually seen configuration. The mattress pad 38 is then unfolded and placed within the playpen, now ready for use by an infant. Relatching of the lock cable 34 will be seen to prevent movement of the connecting rods 28 and hold the support arms 20 in place for maximum strength.

It will be readily apparent to those skilled in the art that the playpen of FIGS. 1–5 exhibits other desirable features, in addition to ease of portability. First of all, it will be seen that the upwards lifting of the support ring 22 will not rotate the corner legs 14 downwards towards the "collapse" position unless the corner legs 14 are first folded to sit atop the support arms 20. This feature of safety is added to by the closure construction itself, wherein a lock release 60 must first be actuated before the support ring 22 can be raised, and wherein a force must be exerted in the upwards lifting of the ring 22 sufficient to overcome the spring bias 70 tending to keep the playpen open. The constraint of the spring bias could also be selected such that a child will be unable to overcome it, requiring an adult strength to do so. Secondly, to protect against a support arm 20 breaking or becoming disconnected from the support ring 22 — thereby making possible an outward movement of a corner leg 14 which could open the playpen so that a child might fall out — the poly rope 12 could be selected of a material to exert a tension and strain to hold and maintain that leg in place. This follows because the poly rope 12 passes through guides 16 in the corner legs 14, and because the rope is secured at each such location, to resist outwardly movement of the corner leg.

Furthermore, it will be seen that the support ring 22 can only be lifted after the mattress 38 has been removed, an added safety feature while the child is in the playpen. Additionally, as contradistinct to may prior art designs wherein a rigid material, e.g. aluminum tubing, defines the top border of the playpen and to which the side netting is laced, the top material of the playpen of this invention is composed of a non-rigid, poly rope of sufficient give and yield to make it more difficult for the child to grab onto in pulling himself over and out of the playpen and, as padded, to protect against accidentally banging the head or mouth against it.

These safety features also exist in the simplified arrangement of the collapsible playpen illustrated in FIGS. 6-8. There, the actuating assembly for opening and closing the playpen comprises the support ring 22 with its plurality of legs 62, along with a pivoting hinge 80 which is spot welded, for example, to the end of the support arm 20 adjacent the ring 22 (FIG. 8). When the support ring 22 is moved upwards in the direction of the arrow 82, the hinge 80 rotates about the pivot point 84 to move the support arm 20 downwards. The cable-slider-track-release arrangement of FIGs. 2–4 can thus be eliminated.

The locking type pivot of the type shown by the locking hinge 86 of FIG. 7 which requires, for instance, a pin 88 to be released and slid within a track 90 from a first, lower position to a second, higher position so as to permit rotation of the corner leg 14 when the playpen is to be collapsed. To further strengthen the construction, the hinge 86 could also be spot welded, as an example, both to the bottom portion of the corner leg 14 and to the end of the support arm 20 adjacent its corner leg 36. Although not shown as such, it will be appreciated that added rigidity and strength could be afforded the open playpen if the support legs 36 were angled outwardly, instead of vertically as illustrated, or having angled supports extending from the vertical leg 36 to meet with the floor.

Also seen from FIGS. 6–8 will be the removal of the hinge 50, around which the corner leg 14 of FIG. 2 was first folded before the corner legs were rotated atop the support arms. This further simplifies the manufacture, and is especially attractive in those instances where the playpen is of the more usual 23–25 inch height. In either event, i.e., with or without the hinge 50, it will be seen that the actuation of the support ring 22 will only rotate the support arm 20 and the corner leg 14 downwards if the corner leg 14 were first folded downward towards the support arm 20, and illustratively held in place by the support ring 22 itself. Added protection will be seen present in the second embodiment of the invention in that the closure will first require individual releasing of the locking hinges for each corner leg, followed by the folding over of each leg, one at a time.

While there have been described what are considered to be preferred embodiments of the present invention, it will be appreciated that modifications may be made by those skilled in the art without departing from the scope of the teachings herein of collapsing a generally square shaped playpen to a cylindrically shaped playpen for ease in carrying about, and of preventing against accidental collapse by restricting the closure until the angular displacement between the corner leg and support arms is reduced below a predetermined amount — preferably until the corner legs seat atop the support arms. Although the invention has been described in terms of playpens of substantially square configurations, it will also be readily apparent that modifications in playpen shape may be made, but with the support arm assemblies being similarly changed, the collapsible features of the present invention would continue. Additionally, it will be noted that while the embodiments described collapse to a cylindrical shape, modifications in the configuration of the support ring 22 will produce changes in the cross-section of the collapsed playpen, as well. For these reasons, the scope of the invention is to be determined by a reading of the Claims which are appended hereto.

We claim:

1. In a playpen enclosed by side materials and intended for portable use, the combination therewith of:

a plurality of corner legs, to which the side materials of the playpen are attached;

a plurality of support arms angularly displaced with respect to said corner legs;

a support member situated within the framework structure of said playpen when open; and means coupling opposite ends of said support arms to said corner legs and to said support member, respectively, said means being so constructed and arranged that actuation of said support member in one direction correspondingly rotates said support arms and corner legs in an opposite direction so as to collapse said playpen to a construction of cross section substantially similar to that of said support member;

said means being operative in conjunction with said corner legs to prevent the collapse of said playpen unless the angular displacement between each of said support arms and said corner legs is first reduced below a predetermined amount prior to the actuation of said support member.

2. The combination of claim 1 wherein said coupling means is operative to prevent the collapse of said playpen unless each of said corner legs is first rotated to seat atop said support arms prior to the actuation of said support member.

3. The combination of claim 1 wherein said coupling means includes lockable pivot means actuable to a lock disengaged position to permit the rotation of said corner legs towards said support arms in reducing the angular displacement therebetween when said playpen is to be collapsed and actuable to a lock engaged position to resist the rotation of said corner legs towards said support arms when said playpen is to be kept open.

4. The combination of claim 3 wherein rope means are also included, secured to the ends of said corner legs remote from said support arms, and of a tension material to exert a predetermined resistance to any rotation of said corner legs outwardly of said playpen when open.

5. The combination of claim 1 wherein said corner legs include guide means in the vicinity of the ends thereof adapted to receive the side materials of said playpen and to hold said side materials in place.

6. The combination of claim 1 wherein are also included to reduce said corner legs to a decreased length, so as to lessen the longest dimension of said playpen construction when said playpen is collapsed to have a construction substantially similar to that of said support member.

7. In a playpen enclosed by side materials and intended for portable use, the combination therewith of:

a plurality of corner legs, to which the side materials of the playpen are attached;

a plurality of support arms;

a support member situated within the framework structure of said playpen when open;

means coupling opposite ends of said support arms to said corner legs and to said support member, respectively, said means being so constructed and arranged that actuation of said support member in one direction correspondingly rotates said support arms and corner legs in an opposite direction so as to collapse said playpen to a construction of cross section substantially similar to that of said support member; and means for reducing said corner legs to a decreased length prior to the actuation of said support member to collapse said playpen, said corner leg length reduction means thereby permitting a lessening of the longest dimension of said playpen construction when said playpen is collapsed to have a construction substantially similar to that of said support member.

8. The combination of claim 7 wherein said corner leg length reduction means permit said legs to be folded substantially in half, and inwardly of said playpen when opened.

9. The combination of claim 1 wherein said corner legs comprise four in number, arranging said playpen in the shape of a square when opened, and wherein said support arms also constitute four in number, extending inwardly from the corners of the square so formed towards the support member within said framework structure.

10. The combination of claim 9 wherein said support member is of ring shaped configuration, such that said playpen is collapsed to a substantially cylindrical construction when said support member is actuated in said one direction.

* * * * *

UNITED STATES PATENT OFFICE

CERTIFICATE OF CORRECTION

Patent No. 4,008,499 Dated February 22, 1977

Inventor(s) William A. Wren, Jr., et al

It is certified that error appears in the above-identified patent and that said Letters Patent are hereby corrected as shown below:

Column 5, Line 1 after "pivot" the words "hinge 52 of FIG. 2 could be" should be inserted.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*